US006720535B2

(12) United States Patent
Hess

(10) Patent No.: US 6,720,535 B2
(45) Date of Patent: Apr. 13, 2004

(54) EXPLOSION PROTECTED HEATING SYSTEM FOR HEATING AN ENCLOSURE WITH TWO TEMPERATURE CONTROL ALGORITHMS

(76) Inventor: Martin Hess, Prinz-Eugen-Strasse, D-85051 Ingolstadt (DE)

( * ) Notice: Subject to any disclaimer, the term of this patent is extended or adjusted under 35 U.S.C. 154(b) by 3 days.

(21) Appl. No.: 10/125,274

(22) Filed: Apr. 18, 2002

(65) Prior Publication Data

US 2002/0158062 A1 Oct. 31, 2002

(30) Foreign Application Priority Data

Apr. 18, 2001 (DE) ..... 101 18 922

(51) Int. Cl.[7] ..... H05B 1/02
(52) U.S. Cl. ..... 219/497; 219/209; 219/506
(58) Field of Search ..... 219/497, 517, 219/209, 506

(56) References Cited

U.S. PATENT DOCUMENTS 4,075,678 A * 2/1978 Levinn ..... 361/104
5,014,776 A * 5/1991 Hess ..... 165/185

FOREIGN PATENT DOCUMENTS

DE 36 33 682 4/1988
DE 43 44 341 7/1995
DE 199 41 901 3/2001
JP 8-51722 * 2/1996
JP 10-62268 * 3/1998
JP 2000-10435 * 1/2000

* cited by examiner

*Primary Examiner*—John A. Jeffery
(74) *Attorney, Agent, or Firm*—McNair Law Firm PA; Cort Flint

(57) ABSTRACT

An electric heating system is disclosed for the heating of the interior of an instrument cabinet which includes a radiator having a receiving cavity with a heating element and a melting fuse connected in series as an excess-temperature fuse encapsulated in the receiving cavity. The heating element and the excess-temperature fuse are connected to a temperature control. An environmental-temperature sensor and a fuse-temperature sensor are encapsulated in the receiving cavity near the melting fuse connected to the temperature control. The current fuse temperature of the excess-temperature fuse is determined by the fuse-temperature sensor. The temperature control operates in a first control algorithm within a fuse temperature range below a preset changeover temperature. The temperature control switches over to a second control algorithm when the changeover temperature has been reached or exceeded and lowers the heating performance of the heating element for the protection of the excess-temperature fuse.

7 Claims, 1 Drawing Sheet

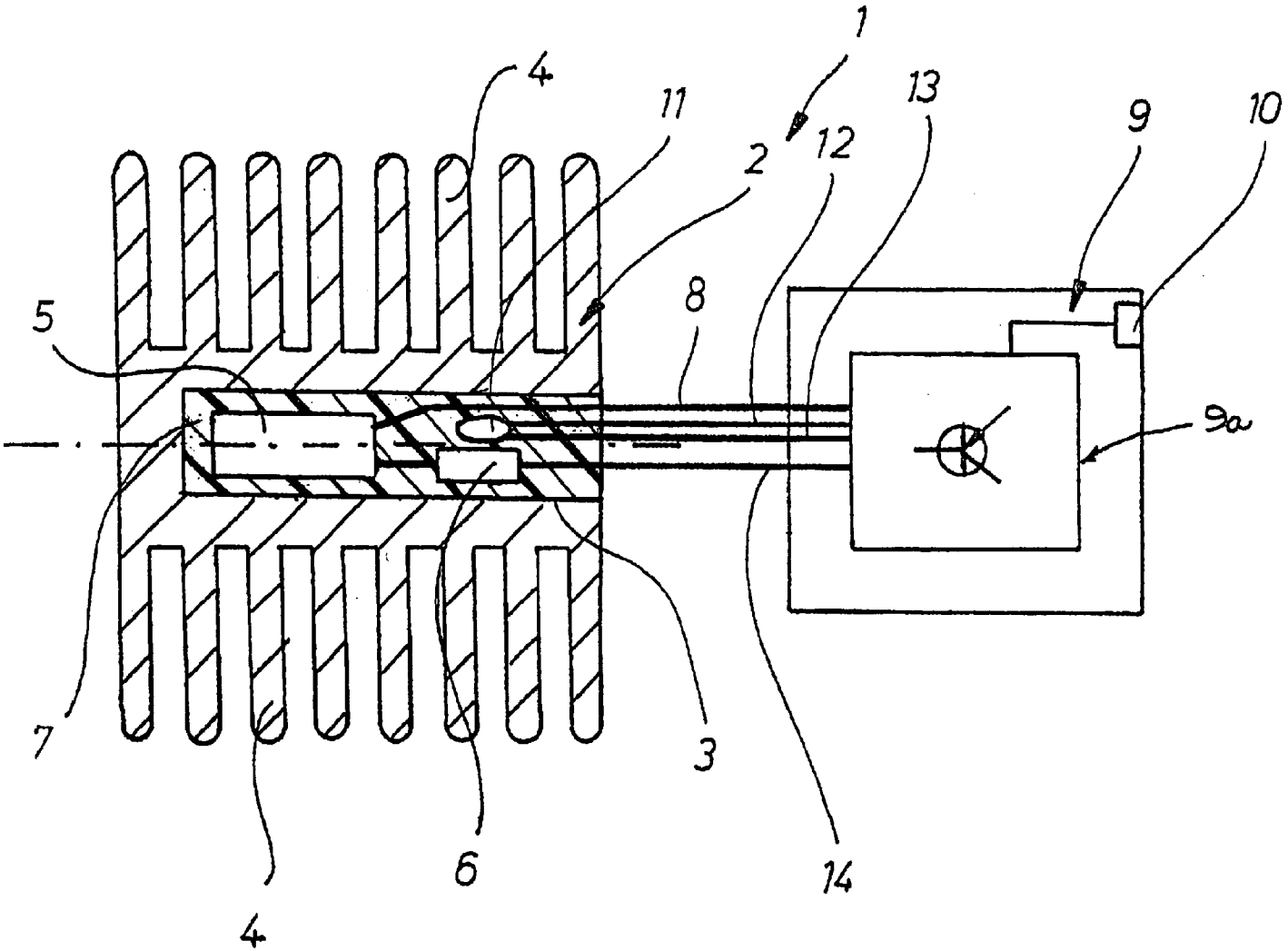
FIGURE

EXPLOSION PROTECTED HEATING SYSTEM FOR HEATING AN ENCLOSURE WITH TWO TEMPERATURE CONTROL ALGORITHMS

The present invention relates to an electrical heating system, in particular for the heating of the interior of an instrument cabinet wherein heating system is protected against explosion.

BACKGROUND OF THE INVENTION

Explosion-protected heating systems are known which take up little space. For example, in industrial plants often a number of measuring instruments connected via valve units to pipe lines are used. In the flow of fluid media, for example, there are pressure or flow measuring points, measured by installations of measuring transducers and valve blocks. Out of doors these installations are normally mounted in protective instrument cabinets and the inside of the instrument cabinet or the built-in instruments themselves are heated directly by thermostatically controlled heating systems. In general, such a heating system is expected to be highly efficient, to require little space, to be adaptable to different conditions, and to adjust precisely to a preset temperature while safety regulations, e.g. with respect to protection against contact and explosion protection. Safety regulations regarding contact safety and explosion safety must be followed in the use of the systems. A known heating system of this type (DE 38 14 145 C2) comprises a heating radiator with a receiving opening, a heating element with an excess-temperature fuse with a different triggering temperature connected in series. The heating element is placed in the receiving opening and is encapsulated. The heating element and the excess-temperature fuse are connected in series, and are connected to a temperature control system. A environmental temperature sensor is also connected to the control system as an indicator of actual temperature. Heating systems of this type must be adapted to actual application conditions, and must be sized so that limit temperatures are not exceeded when in operation with temperature control. However, under adverse conditions, and with the unfavorable marginal conditions, especially if the temperature control overshoots, inadmissible overheating of the heating system is possible in the absence of additional protections. In order to ensure explosion protection, the excess-temperature fuses interrupt the electrical heating circuit if limit temperatures are exceeded. Fuse switching elements that can be reset when their protection function has been triggered have been used in the past as excess-temperature fuses. Manually replaceable melting fuses are also known. When an excess-temperature fuse has been triggered its function could easily and rapidly be restored in the past by resetting the fuse or by replacing it.

According to new guidelines, and allowing some guideline transition time, only melting fuses are allowed for use as excess temperature fuses in cast-encapsulated heating system. It is no longer possible to reset or replace the fuse once it has been triggered if the fuse is encapsulated during casting, so that a cost-intensive replacement of such a heating system becomes necessary.

Accordingly, an object of the present invention is to provide such an electric heating system which is protected from an excess temperature and explosion in which complete replacement of the heating system can be avoided.

SUMMARY OF THE INVENTION

The above objectives are accomplished according to the present invention by installing a fuse-temperature sensor near a protective melting fuse which is encapsulated together with the heating element and fuse in the receiving cavity. The fuse-temperature sensor is connected to the temperature control. With this fuse-temperature sensor the current temperature of the melting fuse can be compared with a changeover temperature set in the temperature control. The changeover temperature generally corresponds to the trigger temperature at which the fuse melts and is selected so that it is at a desired temperature level below the trigger temperature of the melting fuse. The temperature control is designed to operate in the usual manner with a first regulating algorithm in a temperature range below the set changeover temperature as sensed by the fuse-temperature sensor while taking into account the environmental temperature sensor as a current-value indicator. The temperature controls recognize when the changeover temperature is reached and/or exceeded as sensed by the fuse-temperature sensor. The temperature control switches to a second control algorithm to lower the heating performance of the heating element to protect the melting fuse when the changeover temperature is sensed. After a subsequent drop below the trigger temperature, possibly to an undershoot level provided for in the control algorithm, the temperature control switches once more back to the first control algorithm.

The changeover temperature must be selected so that under unfavorable conditions, e.g. in case the temperature control overshoots the temperature in an initial heating phase before the temperature has been adjusted, the fuse trigger temperature is not reached due to the lowering of the heating performance of the heating element. In this way the melting, and thereby destruction, of the encapsulated melting fuse is prevented even under unfavorable operating conditions. The operation of the heating system is maintained and, usually, somewhat longer heat-up times may occur. The operation of the melting fuse as an explosion protection fuse is not affected by the additional use of the fuse-temperature sensor and the modified controls, and is maintained thereby. Thus, it can be seen that sufficient heating operation is available with the arrangement according to the invention under usual conditions and that provisions of explosion protection regulations are observed. Since triggering and melt of excess temperature fuses is prevented, controls as were necessary to determine whether the excess temperature fuses have been triggered can be omitted, as well as the cost of replacement of complete heating systems.

In one aspect of the invention, the arrangement according to the invention can be installed advantageously in known radiators designed as an elongated body with an axial receiving cavity and radially projecting heating fins. The radiator is preferably made of metal to achieve good heat conductivity. It is known to make the radiator entirely as a cast piece or, as described in DE 38 14 145 C2, to make the fins separately and to attach them to a base body. Advantageously, a low-cost NTC resistance can be used as the fuse-temperature sensor. For normal applications, it suffices to set the changeover temperature permanently in the control circuit. Better adaptation to different situations is possible if the changeover temperature is adjusted on the temperature control. Even with an adjustable temperature, the safety function of the encapsulated melting fuse is not affected. For normal applications the control algorithms can be permanently programmed. Advantageously the control algorithm may be designed to be adjustable for the temperature range below the changeover temperature and/or the control algorithm for the range above the changeover temperature.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein the FIGURE is a schematic illustration of an explosion protected heating system according to the invention.

DESCRIPTION OF A PREFERRED EMBODIMENT

Referring now to the drawing, the invention will now be described in more detail.

An electric, explosion-protected heating system, designated generally as A, is illustrated in the FIGURE for the interior heating of a protective instrument cabinet or panel (not shown). The heating system comprises a radiator 2 with a receiving cavity 3. The radiator 2 may be designed as an elongated body with an axial receiving cavity and with radially projecting heating fins 4. The radiator 2 may be cast in metal, for example. As can further be seen from the FIGURE, electric, explosion-protected heating system 1 comprises a heating element 5 and connected in series with an excess-temperature fuse 6 with a certain triggering/melt temperature. The heating element 5 and excess temperature fuse 6 are inserted in the receiving cavity 3 and are encapsulated therein by means of an encapsulating material 7. Heating element 5 and excess-temperature fuse 6 are connected in series via a connection line 8, 14 to a temperature control 9. An environmental-temperature sensor 10 is connected to temperature control 9 and senses the environmental temperature of the cabinet.

Adjacent excess-temperature fuse 6 is a fuse-temperature sensor 11 formed by an NTC resistance which is also encapsulated in the receiving cavity 3. Fuse-temperature sensor 11 is also connected via connection lines 12, 13 to temperature controls 9. The current temperature of the excess-temperature fuse 6 is sensed by fuse-temperature sensor 11 and compared with a set changeover temperature. The changeover temperature is set safely below the triggering/melt temperature of fuse 6. Temperature control 9 has a control circuit 9*a* which normally operates heating element 5 with a first control algorithm in a first temperature range below the changeover temperature, as sensed by fuse-temperature sensor 11. The environmental temperature from sensor 10 and the fuse temperature from sensor 11 are both is taken into account by the temperature control 9 when switching to a second control algorithm when the changeover temperature is reached or exceeded The second algorithm lowers the heating performance of the heating element 5 needed to protect the excess-temperature fuse 6 from melting. It is also possible to make the changeover temperature adjustable in temperature control 9. It is also possible for the first control algorithm for the first temperature range below the changeover temperature and/or the second control algorithm for a second temperature range above the changeover temperature can be made adjustable separately in temperature control 9.

While a preferred embodiment of the invention has been described using specific terms, such description is for illustrative purposes only, and it is to be understood that changes and variations may be made without departing from the spirit or scope of the following claims.

What is claimed is:

1. An electric, explosion-protected heating system for the heating of a interior space in of an instrument cabinet, said heating system being of the type which includes a radiator having a receiving cavity, a heating element and an excess-temperature fuse having a triggering/melt temperature connected in series with said heating element, the heating element and the excess-temperature fuse being disposed in the receiving cavity and encapsulated therein, the heating element and the fuse being connected via electric connection lines to a temperature control, and an environmental-temperature sensor connected as an indicator of actual temperature to the temperature control; wherein said heating system is characterized by:

a fuse-temperature sensor disposed near said excess-temperature fuse for measuring a current fuse temperature, said fuse-temperature sensor being connected to the temperature control;

a changeover temperature being set in said temperature control which is safely below a triggering temperature of said excess-temperature fuse at which said fuse melts;

said temperature control comparing said fuse temperature to said changeover temperature; and said temperature control having a first control algorithm controlling the heating element to operate in a first temperature range when said fuse temperature is below said set changeover temperature, and said temperature control having a second control algorithm controlling the heating element to operate in a second temperature range when said fuse temperature reaches said changeover temperature to lower the heating performance of said heating element.

2. The heating system of claim 1 wherein said radiator includes an elongated body with an axial receiving channel and radial heating fins radially projecting from said elongated body.

3. The heating system of claim 1 wherein said radiator is a metal casting.

4. The heating system of claim 1 wherein said fuse-temperature sensor is an NTC resistance sensor.

5. The heating system of claim 1 wherein said changeover temperature can be adjusted by temperature control.

6. The heating system of claim 1 wherein said first control algorithm for the temperature range below the changeover temperature and/or the control algorithm for the range above the changeover temperature can be adjusted separately by the temperature controls.

7. The heating system of claim 1 wherein said environmental temperature sensor outputs an environmental temperature value to said temperature control for processing with said fuse temperature and changeover temperature.

* * * * *